US006527482B1

(12) United States Patent
Stankus

(10) Patent No.: US 6,527,482 B1
(45) Date of Patent: Mar. 4, 2003

(54) GRIT SURFACE CABLE PRODUCTS

(75) Inventor: John C. Stankus, Canonsburg, PA (US)

(73) Assignee: Jennmar Corporation, Pittsburgh, PA (US)

( * ) Notice: Subject to any disclaimer, the term of this patent is extended or adjusted under 35 U.S.C. 154(b) by 0 days.

(21) Appl. No.: 09/660,819

(22) Filed: Sep. 13, 2000

Related U.S. Application Data

(60) Provisional application No. 60/153,860, filed on Sep. 14, 1999.

(51) Int. Cl.[7] ..... E21D 20/02

(52) U.S. Cl. ..... 405/259.5; 409/259.1; 51/295; 106/36

(58) Field of Search ..... 405/259.1, 259.2, 405/259.5, 259.6; 51/295; 106/36

(56) References Cited

U.S. PATENT DOCUMENTS

| | | | | |
|---|---|---|---|---|
| 4,051,681 A | * | 10/1977 | Yaros | |
| 4,798,501 A | * | 1/1989 | Spies | |
| 5,208,077 A | | 5/1993 | Proctor et al. | 427/461 |
| 5,244,314 A | * | 9/1993 | Calandra et al. | |
| 5,259,703 A | | 11/1993 | Gillespie | 405/259.6 |
| 5,375,946 A | | 12/1994 | Locotos | 405/259.4 |
| 5,378,087 A | | 1/1995 | Locotos | 405/259.5 |
| 5,525,013 A | * | 6/1996 | Seegmiller et al. | |
| 5,565,023 A | * | 10/1996 | Sereboff | |
| 5,570,976 A | * | 11/1996 | Fuller et al. | |
| 5,595,578 A | * | 1/1997 | Stubbs et al. | |
| 5,829,922 A | | 11/1998 | Calandra, Jr. et al. | 405/302.2 |
| 6,074,134 A | | 6/2000 | Stankus et al. | 405/259.6 |

OTHER PUBLICATIONS

Goris, J.M., "Laboratory Evaluation of Cable Bolt Supports" (in two parts), 1. Evaluation of Supports Using Conventional Cables, *U.S. Dept. of the Interior, Bureau of Mines*, Report of Investigations No. 9308 (1990).

Goris, J.M., "Laboratory Evaluation of Cable Bolt Supports" (in two parts), 2. Evaluation of Supports Using Conventional Cables With Steel Buttons, Birdcage Cables, and Epoxy–Coated Cables, *U.S. Dept. of the Interior, Bureau of Mines*, RI No. 9308 (1990).

* cited by examiner

*Primary Examiner*—David Bagnell
*Assistant Examiner*—Daniel P. Stephenson
(74) *Attorney, Agent, or Firm*—Webb Ziesenhiem Logsdon Orkin & Hanson, P.C.

(57) ABSTRACT

A mine roof bolt, preferably one inch or less in diameter, having an external coating configured with particles which mix resin as the mine roof bolt is rotated in a mine roof bore hole.

16 Claims, 2 Drawing Sheets

GRIT SURFACE CABLE PRODUCTS

CROSS-REFERENCE TO RELATED APPLICATION

This application claims the benefit of earlier filed U.S. Provisional Patent Application Ser. No. 60/153,860, filed Sep. 14, 1999 entitled "Grit Surface Cable Products."

BACKGROUND OF THE INVENTION

1. Field of the Invention

The present invention relates to mine roof cable bolts and, more particularly, to coated mine roof cable bolts that are configured to be resin grouted.

2. Brief Description of the Prior Art

A mine roof may be supported by a cable bolt positioned inside a bore hole in a mine roof and resin grouted into place. Examples of mine roof cable bolts are disclosed in U.S. Pat. No. 5,259,703 to Gillespie, U.S. Pat. Nos. 5,375,946 and 5,378,087 both to Locotos, and U.S. Pat. No. 6,074,134 to Stankus et al., herein incorporated by reference.

Cable bolts typically include a single or multi-strand cable segment, a drive head positioned on a first end of the cable segment. A plurality of mixing devices may be positioned along a longitudinal axis of the cable segment, and a stiffening sleeve may be positioned adjacent the first end of the cable segment. These prior art mine roof cable bolts may be tensionable and include one or more mixing devices thereon.

During installation of a cable bolt and mine roof plate system, the first end of a cable segment is generally positioned adjacent a mine roof plate, with the second end inserted into a bore hole created in the earth and rock adjacent a mine roof. Also inserted into the bore hole is a resin catalyst and an adhesive. The cable segment is rotated after insertion, causing the mixing devices to mix the resin catalyst and adhesive. The mixing devices also distribute the adhesive within the rock, in the cracks and crevices between individual strands of a multi-strand cable segment, and in voids between an outer surface of the cable segment and an inner wall of the bore hole. Once cured, the adhesive helps to anchor the cable segment to the earth and rock. Tensionable cable bolts are installed in a similar manner, except that an expansion assembly may also be included to further secure the cable bolt inside the bore hole and tension the bolt between the mine roof and the expansion assembly.

One universal drawback of the cable bolt and mine roof plate systems of the prior art is the trouble and expense associated with incorporating mixing devices, such as nut cages, buttons, or birdcages, into a cable segment. Another drawback is the stiffening sleeve positioned adjacent a first end of the cable segment. In theory, stiffening sleeves help protect the cable segment and prevent the cable bolt from kinking during insertion. However, stiffening sleeves do not prevent torsional deformation of the portion of the bolt not secured in the resin caused when torque is applied to the bolt drive head. When torque is applied during installation of the bolt to mix resin and/or engage a mechanical anchor, a second end of the cable segment decreases rotation as the mechanical anchor and resin restrain movement while the first end is unencumbered. This tends to cause twisting of the cable segment in the portion of the cable bolt between the mine roof and the resin. When installation is complete and torque from the bolt installation machine is removed, the twists in the non-resin grouted portion of the cable untwist which causes the tension applied to the bolt to be reduced.

To counteract the twisting of the lower (ungrouted) portion of the cable, a plurality of sleeves or "buttons" are fixed to the cable lower portion. However, these additional components add to the cost of manufacturing a tensionable cable bolt.

Mixing devices and stiffening sleeves increase manufacturing costs, increase the risk of producing nonconforming goods, and do not prevent torsional deformation. Hence, a need remains for a mine roof cable bolt which resists torsional deformation during installation with subsequent loss of tension, while eliminating or minimizing the need for such extraneous mixing devices and/or stiffening sleeves.

SUMMARY OF THE INVENTION

To obviate the deficiencies of the prior art, one embodiment of the present invention generally includes a cable bolt having a coated cable segment. The cable segment generally includes a first end and a second end with a drive head positioned adjacent the first end of the cable segment.

In single cable segments, the coating is positioned adjacent an exterior surface of the cable segment coating all or only a portion of the exterior surface. In multi-strand cable segments, the coating may completely or partially coat an exterior surface of each strand. Positioned adjacent an exterior surface of the coating are particulates forming a textured surface on the exterior of the cable bolt. A tensioning device may also be positioned along a longitudinal axis of the cable segment. The coating serves three primary functions. First, the coating strengthens the cable segment eliminating the need for a stiffening sleeve in some applications. Second, the coating retards torsional deformation of the cable segment bearing the coating when torque is applied to the drive head. Third, the coating further provides an attachment medium for the particulates. The particulates increase the overall surface area of the cable segment providing more bonding area for the resin and providing agitation of the resin catalyst and adhesive during mixing. The particulates, therefore, reduce the need for mixing devices, such as bulbs and birdcages, in some applications.

It is therefore an object of the present invention to provide a cable bolt that resists torsional deformation, does not require a stiffening sleeve, and in some applications, traditional mixing devices.

These and other advantages of the present invention will be clarified in the Detailed Description of the Preferred Embodiments and the attached figures in which like reference numerals represent like elements throughout.

DETAILED DESCRIPTION OF THE PREFERRED EMBODIMENTS

Figure 1:
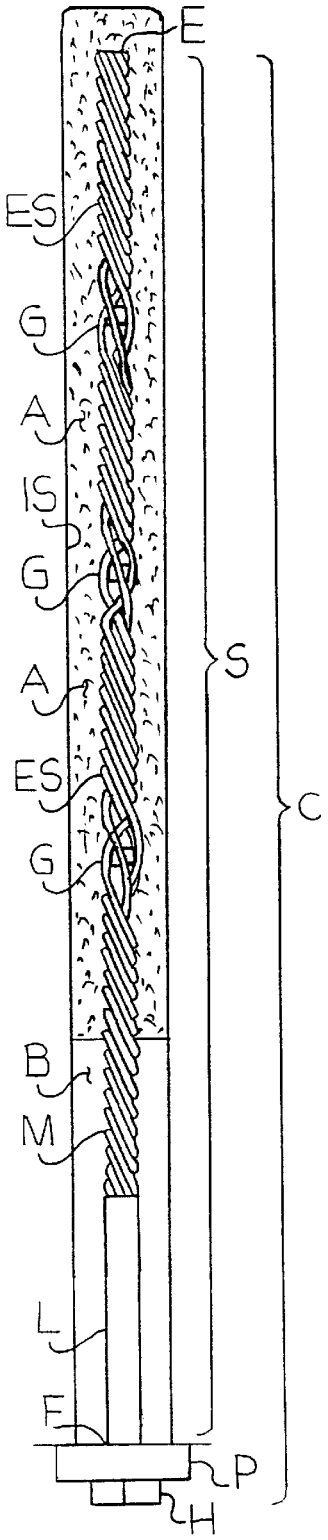
Fig. 1 PRIOR ART
FIG. 1 is a side view of a prior art cable bolt having a multi-strand cable, birdcages, and a stiffening sleeve inserted into a cross-sectional view of a bore hole.
Figure 2:
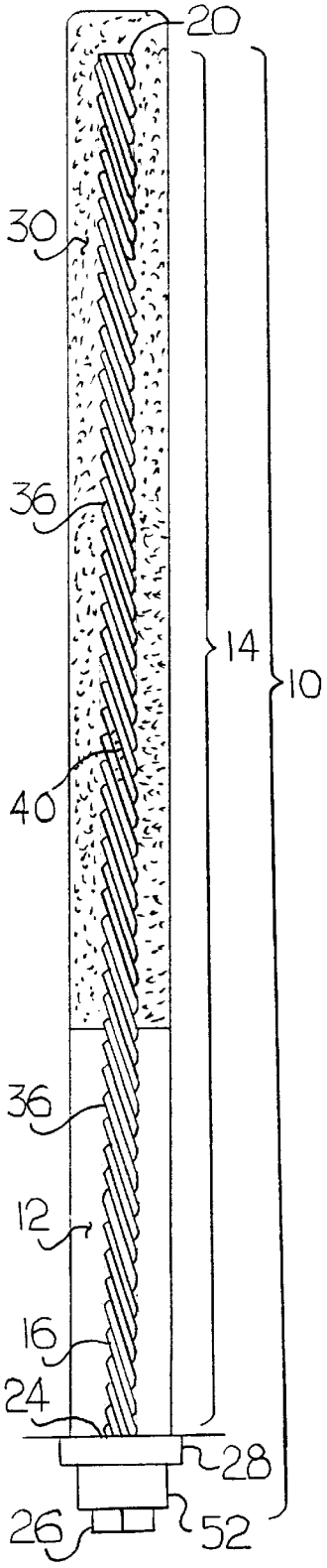
FIG. 2 is a side view of one embodiment of the cable bolt of the present invention inserted into a cross-sectional view of a bore hole.

The preferred embodiment of the cable bolt of the present invention is generally shown in FIG. 2. For purposes of introduction, a prior art device shown in FIG. 1 will be discussed first.

FIG. 1 shows a typical prior art cable bolt C installed in a bore hole B. The cable bolt C generally includes a multi-strand M cable segment S, birdcages G formed in a second end E of cable segment S, a stiffening sleeve L positioned adjacent a first end F of the cable segment S, and a drive head H positioned adjacent the first end F of the cable segment S. The cable bolt C preferably is installed in a mine roof with a mine roof plate P positioned adjacent the drive head H and resin or adhesive A placed at the blind end of the bore hole B between an exterior surface ES of the cable bolt C and an interior surface IS of the bore hole B. Alternatively, the resin and adhesive A may fill all or nearly all of the bore hole B not occupied by the cable bolt C.

As shown in FIG. 2, the cable bolt 10 of the present invention includes a cable segment 14, preferably, multi-strand cable 16 constructed from steel or other suitable material installed in a borehole 12 with a bearing plate 28. The cable segment 14 has a drive head 26 with a conventional load bearing barrel and wedge assembly 52 positioned on a first end 24 of the cable segment 14 and is coated with a layer of a rigid or semi-rigid coating material 36, such as plastic, epoxy, resin, or other suitable material. A suitable assembly of drive head 26 with barrel and wedge assembly 52 is disclosed in U.S. Pat. No. 5,829,922 to Calandra, Jr. et al., incorporated herein by reference. The entire length of cable segment 14 is preferably coated, as shown in FIG. 2, but partial coating is also envisioned.

Figure 6:
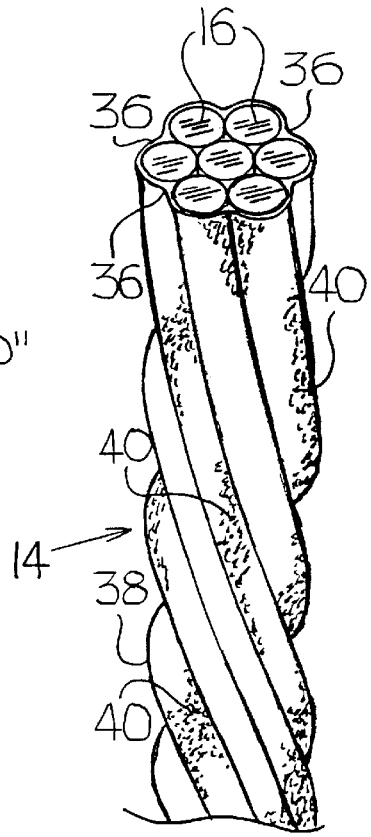
FIG. 6 is a perspective view of a horizontally sectional multi-strand cable segment, as shown in FIG. 2.

As shown in detail in FIG. 6, coating material 36 preferably includes an epoxy material and a plurality of particulates 40, such as grit, sand, rock, diamond dust, or other suitable material dispersed in the epoxy material either on the surface thereof or through the thickness of the coating material 36. The individual particulates 40 should be large enough in diameter to give the exterior surface of the coating material 36 covering the cable segment 14 a textured appearance and feel, but not large enough to significantly alter the overall diameter of the cable segment 14. The coating material 36 preferably is of the type disclosed in U.S. Pat. No. 5,208,777 to Proctor et al., incorporated herein by reference.

It should be apparent to those in the art that the coating material 36 and the particulates 40 need not be two distinct substances provided the coating material 36 forms a textured exterior surface and, preferably, makes the cable segment 14 more rigid.

Figure 3:
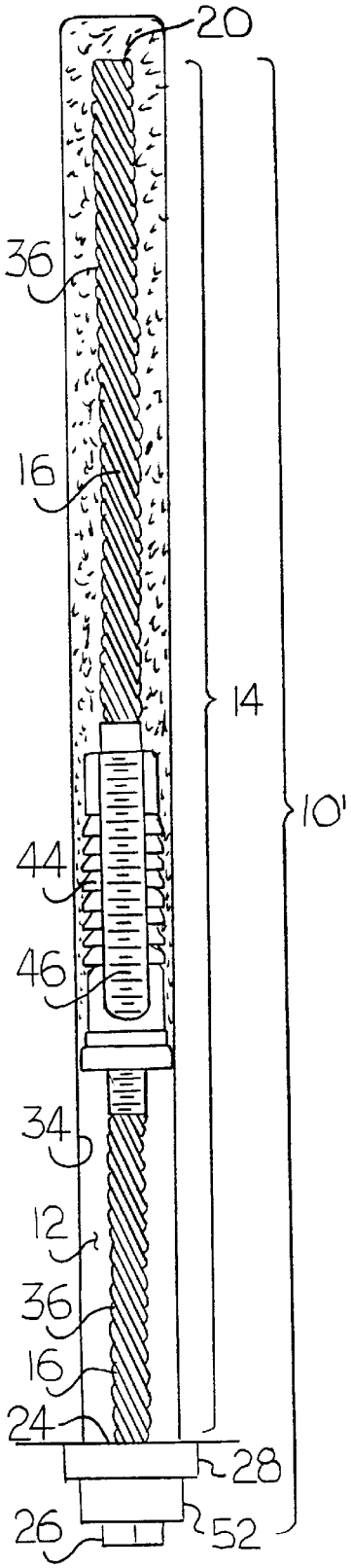
FIG. 3 is a side view of a second embodiment of the cable bolt of the present invention inserted into a cross-sectional view of a bore hole.
Figure 4:
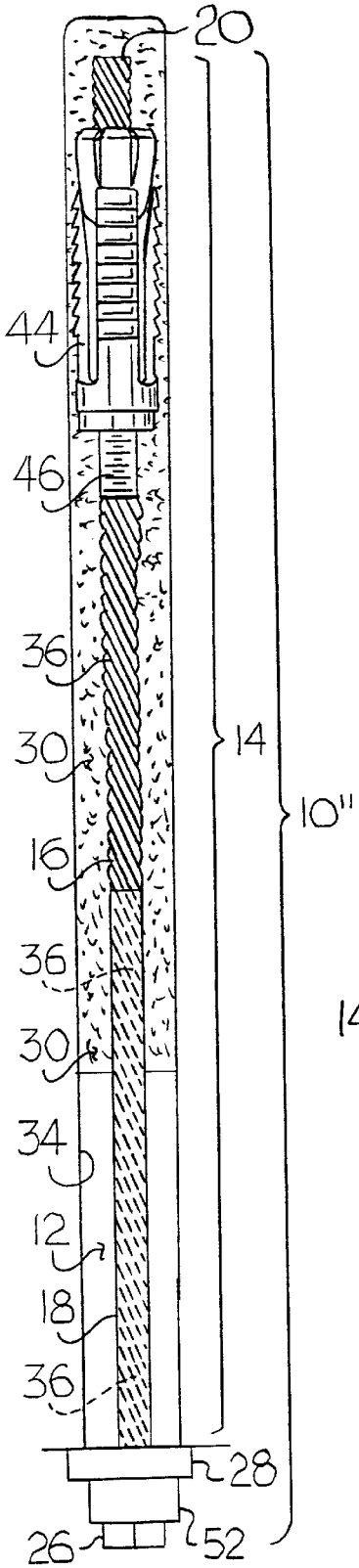
FIG. 4 is a side view of a third embodiment of the cable bolt of the present invention inserted into a cross-sectional view of a bore hole.

The coating material 36 adds rigidity to the cable segment 14, eliminating the need for a stiffening sleeve L, shown in FIG. 1, and reducing torsional rotation in tensionable cable bolts 10' and 10", shown in FIGS. 3 and 4. The coating material 36 also provides a surface of adhesion between resin in a bore hole 12 and the particulates 40. The particulates 40 increase the total exterior surface area of the cable segment 14 which increases the resin catalyst and adhesive 30 bonding area. More importantly, the particulates 40 increase agitation of the resin catalyst and adhesive 30 when the cable segment 14 is rotated in the bore hole 12 during mixing of the resin catalyst and adhesive 30. This agitation eliminates the need for adding birdcages or other traditional mixing devices to cable bolts 10 inserted into smaller bore holes 12, such as those approximately one inch or smaller in diameter.

In a second embodiment, shown generally in FIGS. 3 and 4, the cable bolts 10' and 10" include the cable segment 14 with the coating material 36 and a mechanical anchor 44 threaded onto an externally threaded sleeve 46 surrounding the second end 20 of the cable segment 14 (FIG. 4) as disclosed in U.S. patent application Ser. No. 09/384,524, filed Aug. 27, 1999, entitled "Tensionable Cable Bolt," which is a continuation-in-part of the application resulting in the '134 patent, incorporated herein by reference. Alternatively, the mechanical anchor 44 and sleeve 46 may be located at a position intermediate the first end 24 and the second end 20 of the cable bolt 10", also shown in FIG. 3.

Figure 5:
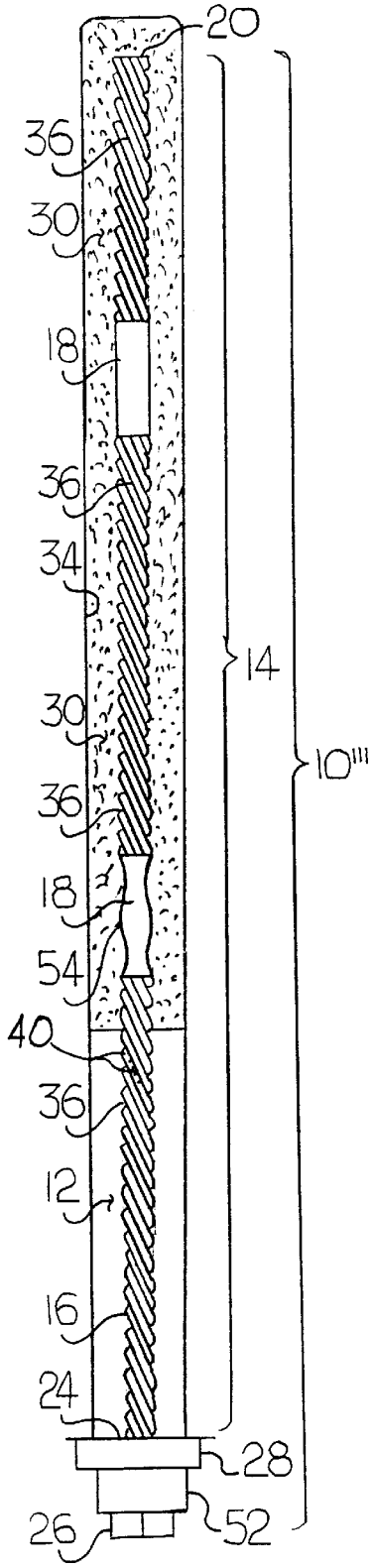
FIG. 5 is a side view of a fourth embodiment of the cable bolt of the present invention inserted into a cross-sectional view of a bore hole.

In a third embodiment, shown in FIG. 5, the cable bolt 10'" includes at least one sleeve or "button" 18 surrounding the cable segment 14 at a position intermediate the first and second ends 24, 20 of the cable segment 14. Preferably, a plurality of buttons 18 are included on cable bolt 10'". The buttons 18 may include longitudinal flanges or wings 54 to increase the resin holding surface area thereof. The embodiment shown in FIG. 5 is used in larger bore holes 12, such as those in the range of one and three-eighths inches diameter or larger. It is believed that in bore holes 12 of one inch in diameter, the cable bolts do not require any additional mixing device beyond the coating material 36, as shown in FIG. 2.

The installation process for the cable bolts 10, 10', 10", and 10'" generally includes the steps of partially or completely coating a cable segment 14 with a textured surface, preferably, using a coating material 36 as described above; drilling a bore hole 12 in a mine roof; inserting resin in the form of two-part catalyst and hardenable component packages into the bore hole 12; inserting a second end 20 of the coated cable segment 14 into the bore hole 12 to rupture the catalyst and hardenable component packages; mixing the resin catalyst and adhesive 30 by rotating the coated cable segment 14 via mine roof bolt installation equipment attached to the drive head 26; and allowing the resin 30 to cure. For the cable bolts 10' and 10", rotation of the bolt also causes expansion of the mechanical anchor 44 which engages with and grips the interior surface 34 of the wall surrounding the bore hole 12. Torsional deformation of the cable segment is significantly reduced and cable bolts 10' and 10" may be tensioned as described in the above-mentioned patents and patent applications. It has been found that the coating material 36 sufficiently stiffens the cable segment 14 which is below the resin 30 to prevent twisting of the cable segment 14 during installation and tension loss upon release of the bolts 10' and 10" from installation equipment.

It is believed that rotation of the cable segment 14 with the coating material 36 sufficiently mixes resin in a one-inch bore hole 12. The particulates 40 embedded in the epoxy material of the coating material 36 provide enhanced mixing over uncoated cable. In addition, the increased surface area of the cable bolts 10, 10', 10", and 10'" of the present invention over uncoated cable segments 14 creates higher holding strength with the resin. In pull tests, cable bolts according to the present invention resisted deflection when subjected to pull forces of between 20 and 29 tons. Hence, the present invention includes a cable bolt coated with a textured material without any alteration to the wrapped strands of the cable segment 14, such as birdcages, nutcages, or bulbs and also includes a method of installing the inventive cable bolt in resin containing bore holes. For larger diameter bore holes (e.g., one and three-eighths inches), altered cable again is believed to be unnecessary to achieve sufficient resin and adhesive 30 mixing and bonding.

However, in certain circumstances simple mixing devices, such as buttons, are required as shown in FIG. 5.

The present invention eliminates the need for a stiffening sleeve L, traditional mixing devices, such as birdcages, or both from conventional mine roof cable bolts while still retarding torsional rotation (in tensionable cable bolts). The textured surface of the cable segment 14 serves to mix the resin 30, provide increased bonding area on the cable segment 14, and increase friction between the resin 30 and the cable bolts 10, 10', 10", and 10'". Moreover, torsional rotation of cable segments 14 in tensionable cable bolts 10' and 10" is reduced within.

The invention has been described with reference to the preferred embodiments. Obvious modifications and alterations will occur to others upon reading and understanding the preceding detailed description. It is intended that the invention be construed as including all such modifications and alterations.

I claim:

1. A mine roof support device for use with a substantially one-inch diameter mine roof bore hole comprising:

an elongated body having a first end, second end, an external surface, and a cross-sectional diameter less than the diameter of said mine roof bore hole;

a resin mixing device positioned on said external surface of said elongated member, said resin mixing device comprising a coating forming a layer on said external surface; and said coating is a rigid material containing a plurality of particulates, wherein one or more of said plurality of particulates protrudes through said layer of said coating, forming a textured surface suitable for mixing resin; and a drive head position adjacent said first end of said elongated body for rotating said elongated body and agitating said resin mixing device.

2. The mine roof support device as claimed in claim 1 wherein said elongated body is a cable segment having multiple strands.

3. The mine roof support device as claimed in claim 2 wherein said coating is positioned between each of said multiple strands.

4. The mine roof support device as claimed in claim 1 further comprising a mechanical anchor positioned between said first end and said second end of said elongated body.

5. The mine roof support device as claimed in claim 1 further comprising a button positioned between said first end and said second end of said elongated body.

6. The mine roof support device as claimed in claim 1 further comprising a barrel and wedge assembly positioned adjacent said drive head.

7. The mine roof support device as claimed in claim 6 further comprising a bearing plate positioned adjacent said barrel and wedge assembly.

8. A method of supporting a mine roof comprising the steps of:

drilling a bore hole in a mine roof;

inserting resin in said bore hole;

providing an elongated body having a first end, second end, an external surface, a resin mixing device positioned on said external surface of said elongated body, said resin mixing device comprising a rigid coating forming a layer, and at least one particulate received in said rigid coating;

inserting said second end of said elongated body into said bore hole; and rotating said elongated body such that said at least one particulate mixes said resin.

9. The method of supporting a mine roof as claimed in claim 8 wherein said elongated body further comprises a mechanical anchor positioned between said first end and said second end of said elongated member and further comprising the step of engaging said mechanical anchor with a wall surrounding the bore hole while rotating said elongated body.

10. The method of supporting a mine roof as claimed in claim 8 wherein said elongated body is a cable segment having multiple strands.

11. The method of supporting a mine roof as claimed in claim 10 wherein said coating is further positioned between each of said multiple strands.

12. The method of supporting a mine roof as claimed in claim 8 wherein said elongated body further comprises a button positioned between said first end and said second end of said elongated body.

13. The method of supporting a mine roof as claimed in claim 8 wherein said elongated body further comprises a drive head positioned adjacent said first end of said elongated body.

14. The method of supporting a mine roof as claimed in claim 13 wherein said elongated body further comprises a barrel and wedge assembly positioned adjacent said drive head.

15. The method of supporting a mine roof as claimed in claim 14 wherein said elongated body further comprises a bearing plate positioned adjacent said barrel and wedge assembly.

16. A mine roof support device for use with a substantially one inch diameter mine roof bore hole comprising:

a multi-strand cable bolt having:

a first end, second end, an external surface, and a cross-sectional diameter of about one inch or less;

a resin mixing device positioned on each strand of said multi-strand cable bolt and said external surface of said multi-strand cable bolt, said resin mixing device comprising a rigid coating forming a layer on said external surface said rigid coating containing a plurality of particulates, wherein said plurality of particulates protrudes through said layer of said rigid coating, forming a textured surface suitable for mixing resin;

a drive head positioned adjacent said first end of said multi-strand cable for rotating said multi-strand cable bolt and agitating said resin mixing device;

a barrel and wedge assembly positioned between said drive head and said second end; and a bearing plate positioned between said barrel and wedge assembly and said second end.

* * * * *